United States Patent [19]

Nonis

[11] Patent Number: 4,502,640

[45] Date of Patent: Mar. 5, 1985

[54] MULTI-PURPOSE SPRAY GUN

[76] Inventor: Italo Nonis, 5163 Derry Road West, R.R. No. 2, Milton, Ontario, Canada, L9T 2X6

[21] Appl. No.: 415,893

[22] Filed: Sep. 8, 1982

[51] Int. Cl.[3] ..... B05B 7/30

[52] U.S. Cl. ..... 239/346; 239/375; 239/396; 239/538

[58] Field of Search ..... 239/345, 346, 354, 396, 239/538, 375; 222/553, 555, 548

[56] References Cited

U.S. PATENT DOCUMENTS

| | | | |
|---|---|---|---|
| 2,310,620 | 2/1943 | Dye | 222/553 |
| 2,887,274 | 5/1959 | Swenson | 239/375 |
| 2,964,302 | 12/1960 | Tombu | 239/345 |

*Primary Examiner*—John J. Love

*Assistant Examiner*—James R. Moon, Jr.

*Attorney, Agent, or Firm*—Ridout & Maybee

[57] ABSTRACT

A spray gun is disclosed intended alternatively for the application of plaster to walls, and the application of particulate finishing materials to the wet plaster. The gun has a hand held stock supporting a tubular housing, which receives at its front end interchangeable barrels having apertures in their side walls which can be brought into coincidence with an aperture in the housing communicating with a supply of material to be sprayed. One barrel has a handle so that it can be rotated in the housing to adjust the degree of coincidence between the openings and thus control release of particulate material into the barrel, while the other barrel is provided with a nozzle for the spraying of plaster. Compressed air for carrying out the spraying is admitted through an axial pipe connected to an external trigger.

6 Claims, 2 Drawing Figures

MULTI-PURPOSE SPRAY GUN

FIELD OF THE INVENTION

This invention is directed to compressed air operated hand held spray guns for applying finishes to walls and similar surfaces.

BACKGROUND OF THE INVENTION

It is known to apply plaster, stucco and other textured wall finishes using hand held spray guns operated by compressed air. A typical spray gun used for this purpose is that sold by Bliss & Laughlin Industries under the trade mark GOLDBLATT. These spray guns are essentially adaptations of the compressed air operated spray guns utilized to spray paints and lacquers, modified so as to be able to handle sprayable materials of various textures and consistencies. Such guns are inevitably prone to occasional blockage, jamming and damage by the material being sprayed, and since it is often impracticable to dismantle the gun to correct such problems on site, an adequate supply of spare guns must be available. Moreover, such guns are neither designed for nor capable of spraying the coarse particulate materials used as a surface layer on some types of wall finish such as pebble-dash.

It is also known to provide fluid operated guns to project a stream of sand or grit for cleaning and removing previous finishes from walls by sand-blasting, but these are clearly not suited for applying particulate material to an unhardened wall finish, nor even if adapted for this purpose would they have the versatility to handle a wide range of particulate materials with a readily controllable rate of application. Moreover most such blasting guns require a fairly sophisticated system for delivering the particulate material.

SUMMARY OF THE INVENTION

The applicant is seeking to provide an air operated gun which is adaptable not only to applying particulate material to plaster, but will also apply the plaster itself, whilst being of a construction which not only minimizes the risk of jamming or blockage but permits ready disassembly on site should a problem occur.

According to the invention, there is provided a hand held compressed air spray gun comprising a stock member supporting a tubular housing, defining a uniform cylindrical bore having front and rear ends and an aperture in the wall of the bore near its front end, and a trigger mechanism external to the tubular housing, a breech block secured in the rear end of the bore, at least one barrel assembly including a cylindrical barrel receivable in the front end of the bore, said barrel defining an opening at a muzzle end and an aperture in a cylindrical wall of the barrel axially adjacent the aperture in the tubular housing, an air pipe extending axially relative to the barrel from a connection at its rear end for coupling to a source of compressed air forwardly through a breech end of the barrel and terminating in a nozzle within the barrel, means coupling the air pipe to the barrel, and means releasably coupling the rear end of the air pipe to the trigger mechanism when the barrel is located in the bore so that the rear end of the air pipe extends rearwardly through a bore in the breech block, whereby to retain the barrel assembly in the housing.

This provides a structure which is easily dismantled and cleaned, since the trigger mechanism is wholly external to the barrel, and the parts exposed to the material to be sprayed are housed in a uniform cylindrical bore from which they can readily be removed. The barrel assembly can readily be changed to suit different materials and different modes of operation.

Different types of barrel assembly may be used, preferably interchangeably. In one type of assembly the means coupling the pipe to the barrel is such as to restrain axial movement of the pipe relative to the barrel, whilst permitting rotational movement of the barrel relative to the tubular housing, and wherein the barrel is provided with a handle for the manual application of rotational movement thereto whereby to adjust the degree of coincidence between the aperture in the barrel and the aperture in the housing and to control the passage of material from the hopper into the barrel for entrainment by air passed through the pipe. In another type, the means coupling the pipe to the barrel is such as to permit relative axial movement of the pipe relative to the barrel, and an aperture plate is located at the front end of the barrel, the nozzle of the pipe having a normal position closing an aperture of the aperture plate, the trigger mechanism when coupled to the rear end of the air pipe being operative to move the latter axially so that the nozzle moves between its normal position and a position inward of the aperture, whereby material entering the barrel from the hopper may be entrained by air passed through the pipe.

The invention also extends to a hand held compressed air gun for spraying particulate materials comprising a hand held stock supporting a tubular housing, a barrel member having a breech end rotatably supported in the tubular housing, a handle attached to the barrel forwardly of the housing whereby the latter may be manually rotated relative to the tubular housing, a hopper for particulate material mounted on the tubular housing above an opening defined therein, the breech end of the barrel defining a further opening in the side wall of the barrel whereby on rotation of the barrel there is a continuously variable degree of coincidence between the opening in the breech end of the barrel and the opening in the breech block, and an air supply pipe extending axially through the breech block and the breech end of the barrel to a nozzle adjacent the opening therein and directed towards the nozzle end of the barrel, whereby to eject material falling into the barrel from the hopper.

IN THE DRAWINGS

FIG. 1 is a longitudinal vertical section through a preferred embodiment of a spray gun in accordance with the invention, showing one of two alternate types of barrel fitted to the gun; and FIG. 2 is a similar longitudinal vertical section, showing another alternative type of barrel, the unchanged part of the gun being shown in outline only.

DESCRIPTION OF THE PREFERRED EMBODIMENT

Figure 1:
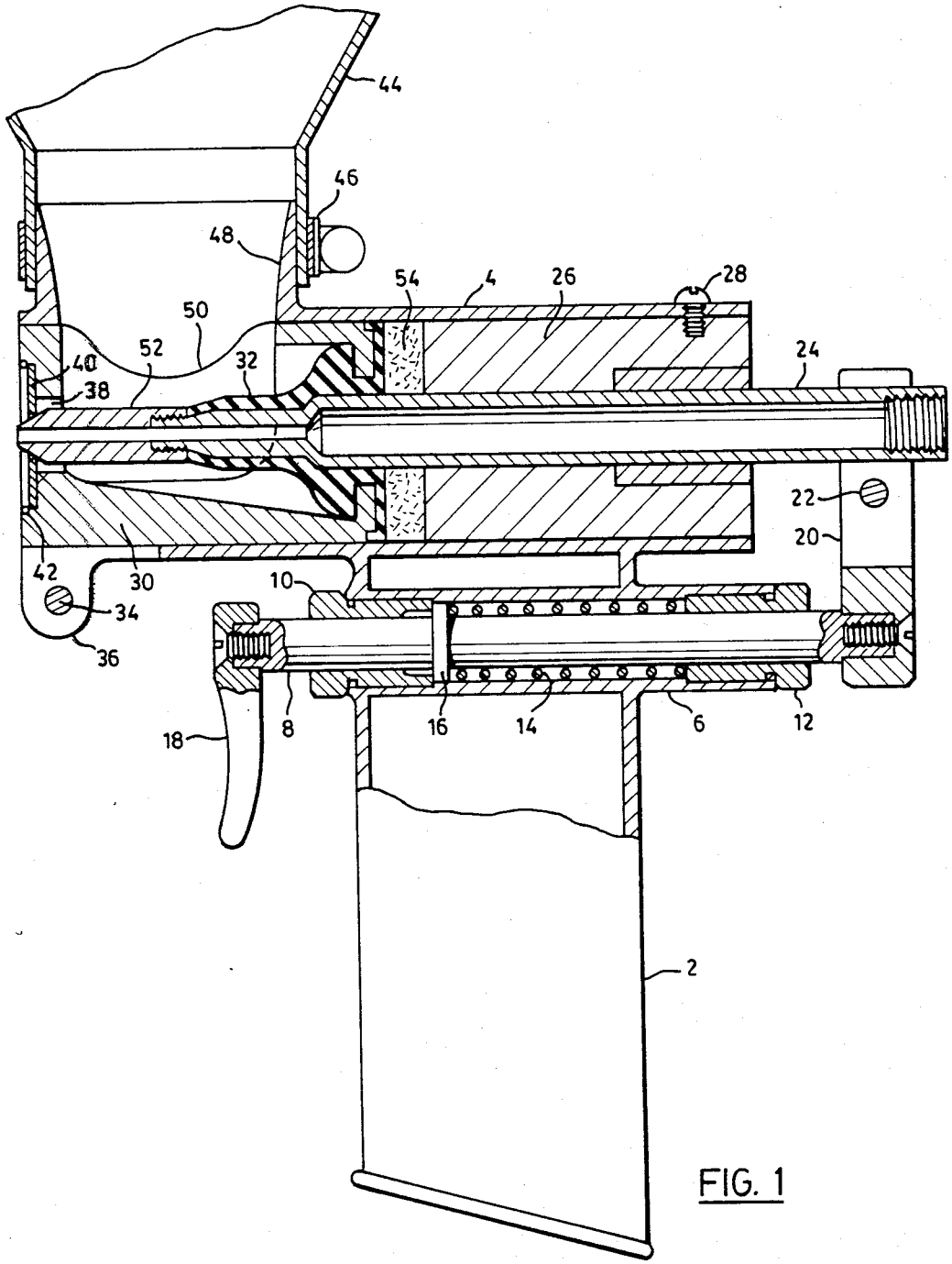

The body of the gun comprises a vertical handle or stock 2, an open ended tubular housing 4 mounted across the top of the stock, and a second tubular housing 6 of smaller diameter extending through the stock parallel to and beneath the first housing. The second housing accommodates a plunger 8 passing through caps 10 and 12 screwed into the ends of the housing. A spring 14 acts between the cap 12 and a flange 16 on the plunger to bias it forwardly (to the left as shown in FIG. 1). A trigger 18 is attached to the front end of the plunger, the plunger and trigger being biassed by the spring to to assume the position shown. Pressure on the trigger tends to move the plunger rearwardly. A coupling member 20 is secured to the rear end of the plunger and is releasably clamped by a screw 22 to the rear end of an air pipe 24 which extends axially into the first tubular housing through a cylindrical breech block 26 secured against displacement by a screw 28. The air pipe 24 is threaded at its rear end for attachment to a compressed air line.

The air pipe 24 shown in FIG. 1 forms part of an interchangeable assembly incorporating a cylindrical barrel 30 received in the front part of the tubular housing. The assembly further comprises a rubber boot 32 forming a seal between the pipe 24 and the barrel 30 whilst permitting limited axial movement of the pipe relative to the barrel, which latter is clamped in place within the tubular housing by a screw 34 acting on flanges 36 formed on a split outer end of the housing 4. The barrel 30 has a nozzle opening 38 within which an orifice plate 40 is retained by a split ring 42. A nozzle 52 screwed into the outer end of the pipe 24 normally closes an orifice in the orifice plate. A felt washer 54 is located between the barrel 30 and the breech block 26.

A hopper 44 is secured by a clamp 46 to a funnel shaped opening 48 in the top of the housing 4, which opening coincides with an opening 50 in the top of the barrel so that material such as plaster placed in the hopper can enter the barrel.

When the air pipe 24 is connected by a hose (not shown) to a source of compressed air (not shown) and the trigger 18 is depressed, the air pipe 24 is drawn rearwardly thus withdrawing the nozzle 52 from the orifice in the orifice plate 40 so that air emerging from the nozzle entrains the plaster and sprays it forwardly through the orifice according to the conventional principle of operation of air operated gravity feed spray guns. On the other hand, as compared with conventional guns, possible causes of jamming are eliminated since the trigger mechanism and associated spring is separately housed from the gun proper, in which the only part is the pipe 24 with its nozzle 52. Those portions of the pipe 24 which are in sliding contact with other parts of the gun are of smooth cylindrical form, and outside of the barrel itself there are no voids within the structure to become clogged or block with hardened material. The entire barrel assembly including the pipe 24 can be readily removed simply by loosening the screws 22 and 34, whilst the breech block 26 is also secured by the single screw 28, and upon their removal the housing 4 presents a smooth, uniform cylindrical bore. Thus disassembly and cleaning of the gun is extremely simple and there are also advantages in manufacture since the gun parts require only a minimum of very simple and straightforward machining operations.

Figure 2:
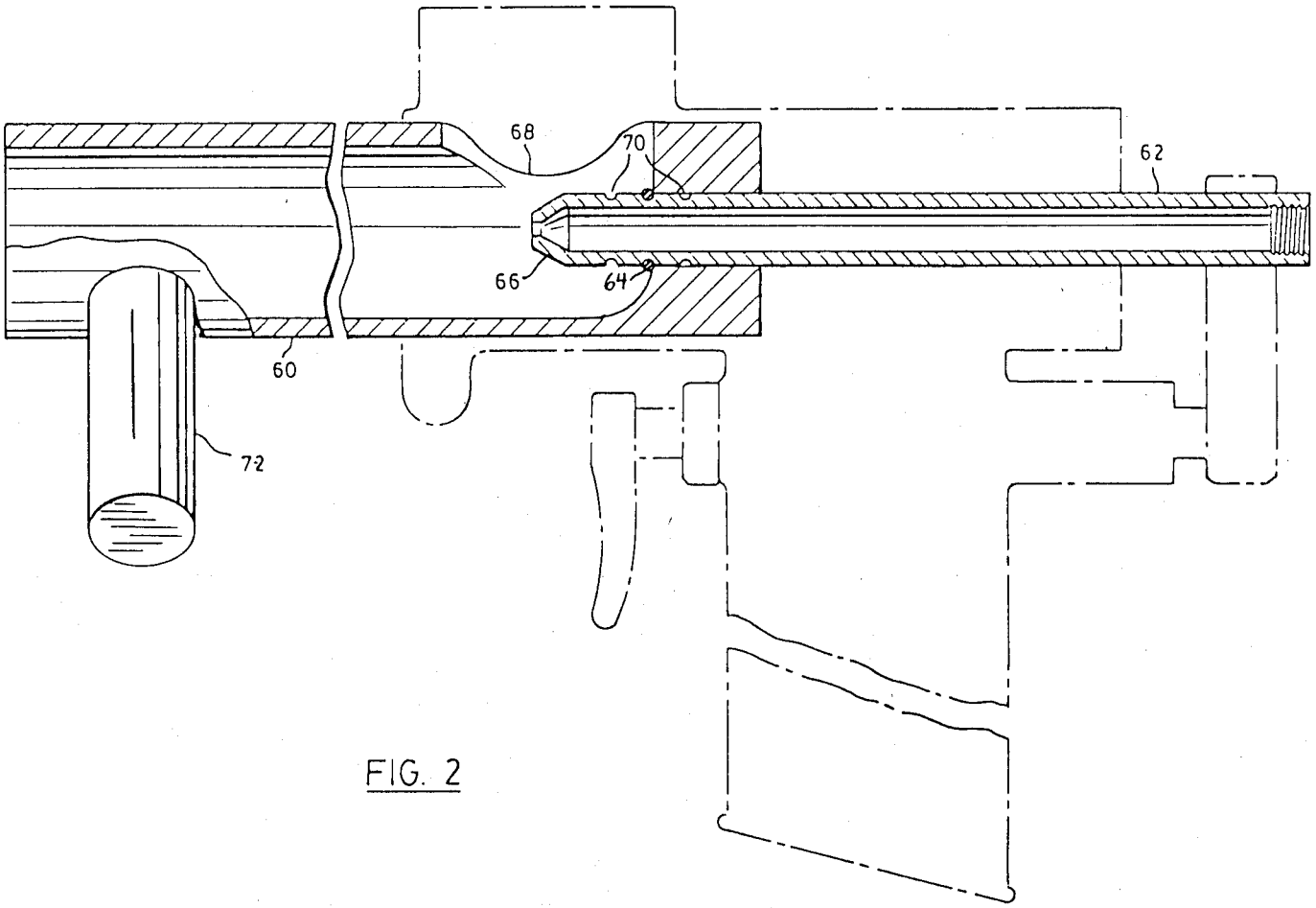

Upon removing the barrel assembly comprising the barrel 30 and the pipe 24, this may be replaced by the alternative assembly shown in FIG. 2. This assembly also comprises a barrel 60 and a pipe 62, but is installed and operated somewhat differently in order to adapt the gun for the application of solid particulate material to the surface of a previously applied matrix layer to which the particulate material adheres.

The pipe 62 passes through an axial orifice in the breech end of the barrel 60, and is secured against withdrawal from it by a rubber O-ring 64 which also serves as a seal whilst permitting rotation of the barrel relative to the pipe. In order to provide for different locations of a nozzle 66 formed at the outer end of the pipe relative to an opening 68 formed in the side of the breech end of the barrel, several peripheral grooves 70 may be provided in the pipe 62 to provide alternative seatings for the O-ring 64. The rear end of the pipe 62 is clamped by the screw 22 as before, but the O-ring 64 prevents rearward movement of the pipe relative to the barrel 60. Thus the trigger 18 and its associated mechanism is inopeative, except as a means to hold the pipe 22 against movement and thus in turn to hold the breech end of the barrel 60 in the housing 4.

The O-ring 64 allows the barrel 60 to be rotated in the housing by means of a hand grip 72 so that the degree of coincidence of the opening 68 with the opening 48 in the housing 4 can be continuously varied from full coincidence to zero coincidence, thus regulating the rate at which particulate material can flow from the hopper 44 into the interior of the barrel 60.

The material so flowing is ejected from the nozzle end of the barrel by air emerging from the nozzle 66 when the pipe 62 is connected to a source of compressed air. The groove 70 in which the O-ring 64 is located is selected to provide the best results according to the particle size and density of the material to be sprayed. The gun is held with both hands, one on the stock 2, and the other on the hand grip 72, this second hand steadying and aiming the gun and also regulating the flow of particulate material into the barrel.

As before the structure of the gun is such that it is very easily dismantled and serviced, and the risk of jamming or blockage is minimized.

I claim:

1. A hand held compressed air gun for spraying particulate materials comprising a hand held stock supporting a tubular housing, a barrel member having a breech end rotatably supported in the tubular housing, a handle attached to the barrel forwardly of the housing whereby the latter may be manually rotated relative to the tubular housing, means for mounting a hopper for particulate material on the tubular housing above an opening defined therein, the breech end of the barrel defining a further opening in the side wall of the barrel whereby on rotation of the barrel there is a continuously variable degree of coincidence between the opening in the breech end of the barrel and the opening in the breech block, and an air supply pipe extending axially through the breech block and the breech end of the barrel to a nozzle adjacent the opening therein and directed towards the nozzle end of the barrel, whereby to eject material falling into the barrel from the hopper.

2. A hand held compressed air spray gun comprising a stock member supporting a tubular housing, defining a cylindrical bore having front and rear ends and an aperture in the wall of the bore near its front end, and a trigger mechanism external to the tubular housing, a breech block at the rear end of the bore, at least one barrel assembly including a cylindrical barrel removably receivable in the front end of the bore, said interchangeable barrel defining an opening at a muzzle end and an aperture in a cylindrical wall of the barrel axially adjacent the aperture in the tubular housing, an air pipe extending axially relative to the barrel from a connection at its rear end for coupling to a source of compressed air forwardly through a breech end of the barrel and terminating in a nozzle within the barrel, means releasably coupling the rear end of the air pipe to the trigger mechanism when the barrel is located in the bore so that the rear end of the air pipe extends rearwardly through a bore in the breech block, and means to retain the barrel in the housing.

3. A hand held compressed air gun for spraying particulate materials comprising a hand held stock supporting a tubular housing, a barrel member having a breech end rotatably supported in the tubular housing, a handle attached to the barrel forwardly of the housing whereby the latter may be manually rotated relative to the tubular housing, means for mounting a hopper for particulate material on the tubular housing above an opening defined therein, the breech end of the barrel defining a further opening in the side wall of the barrel whereby on rotation of the barrel there is a continuously variable degree of coincidence between the opening in the breech end of the barrel and the opening in the breech block, and an air supply pipe extending axially through the breech block and the breech end of the barrel to a nozzle adjacent the opening therein and directed towards the nozzle end of the barrel, whereby to eject material falling into the barrel from the hopper, wherein the means to retain the barrel in the housing is such as to restrain axial movement of the pipe relative to the barrel, whilst permitting rotational movement of the barrel relative to the tubular housing, and wherein the barrel is provided with a handle for the manual application of rotational movement thereto whereby to adjust the degree of coincidence between the aperture in the barrel and the aperture in the hopper into the barrel for entrainment by air passed through the pipe.

4. A gun according to claim 3, wherein the means to retain the barrel in the housing is an O-ring within the barrel and selectively engaged with one of a plurality of axially spaced peripheral grooves in the external surface of the pipe.

5. A gun according to claim 2, including at least two interchangeable barrel assemblies, in one of which the means to retain the barrel in the housing is such as to permit rotational movement of the barrel relative to the tubular housing, and wherein the barrel is provided with a handle for the manual application of rotational movement thereto whereby to adjust the degree of coincidence between the aperture in the barrel and the aperture in the housing and to control the passage of material from the hopper into the barrel for entrainment by air passed through the pipe, and in the other of which the means coupling the pipe to the barrel is such as to permit relative axial movement of the pipe relative to the barrel, and an aperture plate is located at the front end of the barrel, the nozzle of the pipe having a normal position closing an aperture of the aperture plate, the trigger mechanism when coupled to the rear end of the air pipe being operative to move the latter axially so that the nozzle moves between its normal position and a position inward of the aperture, whereby material entering the barrel from the hopper may be entrained by air passed through the pipe.

6. A gun according to claim 2, wherein the means to retain the barrel in the housing is such as to permit relative axial movement of the pipe relative to the barrel, and an aperture plate is located at the front end of the barrel, the nozzle of the pipe having a normal position closing an aperture of the aperture plate, the trigger mechanism when coupled to the rear end of the air pipe being operative to move the latter axially so that the nozzle moves between its normal position and a position inward of the aperture, whereby material entering the barrel from the hopper may be entrained by air passed through the pipe.

* * * * *